US005727991A

United States Patent [19]

Main

[11] Patent Number: 5,727,991

[45] Date of Patent: Mar. 17, 1998

[54] METHOD AND APPARATUS FOR IN SITU BLADE SHARPENING

[76] Inventor: Richard E. Main, P. O. Box 638, Raton, N. Mex. 87740-0638

[21] Appl. No.: 534,506

[22] Filed: Sep. 27, 1995

[51] Int. Cl.[6] ..... B24B 1/00

[52] U.S. Cl. ..... 451/48; 451/421; 451/419; 451/45

[58] Field of Search ..... 451/45, 48, 63, 451/260, 278, 280, 419, 420, 421, 422, 439

[56] References Cited

U.S. PATENT DOCUMENTS

| | | | |
|---|---|---|---|
| 962,047 | 6/1910 | Peterson . | |
| 1,074,739 | 10/1913 | Pixley . | |
| 2,620,606 | 12/1952 | Dvorak | 51/249 |
| 2,651,219 | 9/1953 | Tower et al. | 451/419 |
| 2,729,923 | 1/1956 | Durst | 51/173 |
| 2,735,248 | 2/1956 | West et al. | 451/419 |
| 2,788,623 | 4/1957 | Proctor | 451/419 |
| 3,139,710 | 7/1964 | Ralston | 451/421 |
| 3,149,444 | 9/1964 | Schneider | 51/249 |
| 3,354,589 | 11/1967 | Postula et al. | 51/249 |
| 3,683,564 | 8/1972 | Lawrence | 51/249 |
| 3,691,702 | 9/1972 | Smith et al. | 51/249 |
| 3,738,067 | 6/1973 | Smith | 51/249 |
| 3,828,486 | 8/1974 | Bonke | 51/249 |
| 4,321,773 | 3/1982 | Fleming | 451/421 |
| 5,159,784 | 11/1992 | Varner, Sr. et al. | 451/419 |

FOREIGN PATENT DOCUMENTS

| | | |
|---|---|---|
| 857 902 | 7/1949 | Germany . |
| 258 275 | 11/1948 | Switzerland . |
| 484 068 | 11/1972 | U.S.S.R. . |

*Primary Examiner*—James G. Smith
*Assistant Examiner*—Dona C. Edwards
*Attorney, Agent, or Firm*—Deborah A. Peacock; Paul Adams; Jeffrey D. Myers

[57] ABSTRACT

An apparatus and method for sharpening machine tool cutter blades in situ is disclosed. A connector adjustably connects a powered sharpening device to the apparatus. Further adjustment of the apparatus relative to the blades is provided by a body member mounting adjustable arms. One of the arms engages the back of the blade being sharpened, thereby providing a reliable and true reference. A second embodiment sharpens rotary saw blades while a third embodiment sharpens router and shaper bits.

17 Claims, 8 Drawing Sheets

METHOD AND APPARATUS FOR IN SITU BLADE SHARPENING

BACKGROUND OF THE INVENTION

1. Field of the Invention (Techical Field)

The invention relates to a blade sharpening jig referencing the blade to be sharpened; and a method for using such jig.

2. Background Art

The prior art is replete with devices for sharpening planer-jointer blades in situ. Removal of the blades from the cutter head for sharpening involves a costly grinding process. Further, resetting the blades in the cutter head at the correct height is not only difficult, but required, and is critical to proper operation of the planer or jointer.

Accordingly, the prior art has devised many ways of indexing or referencing the cutter blades in order to assure an accurate and uniform in situ sharpening process.

Much of the prior art references only the table of the planer-jointer. While U.S. Pat. No. 2,729,923, to Durst, entitled *Jointer Sharpener*, includes an indexer block, the true reference during sharpening is, ultimately, the planer-jointer table itself. Similarly, U.S. Pat. No. 962,047, to Peterson, entitled *Planer Knife Sharpener*, which uses the planer table as a reference plane. U.S. Pat. No. 3,738,067, to Smith, entitled *Jointer Blade Grinder* likewise indexes only the jointer table.

Other prior art disclosures index or reference both the planer-jointer table and the cutter head shaft. U.S. Pat. No. 3,691,702, to Smith, et al., entitled *Jig for Sharpening Jointer Blades and the Like*, includes a table mount as well as a shaft-mounted indexing collar. U.S. Pat. No. 3,354,589, to Postula, et al., entitled *Portable Jointer Sharpener* includes a table mount for the sharpening jig as well as a securing member engaging the cutter head. Likewise U.S. Pat. No. 3,149,444, to Schneider, entitled *Hook-on Sharpening Attachment*; U.S. Pat. No. 2,620,606, to Dvorak, entitled *Portable Jointer Knife Guide*; U.S. Pat. No. 3,683,564, to Lawrence, entitled *Means for Sharpening the Blade of a Jointer or Planer*; U.S. Pat. No. 3,828,486 to Bonke; and German Patent No. 857,902 entitled *Sharpening Device*, all employ the planer-jointer table as well as cutter shaft referencing devices.

The truest index for planer-jointer blade sharpening is believed the cutter head alone. Among the prior art using this referencing scheme are U.S. Pat. No. 1,074,739, to Pixley, entitled *Grinding Device for Machine Tools*, which provides a frame mountable directly on the cutter shaft for supporting the sharpening device. Swiss Patent No. 258,375 also mounts a sharpening device upon the cutter shaft, as does Soviet reference 484,068.

SUMMARY OF THE INVENTION (DISCLOSURE OF THE INVENTION)

The present invention is of an apparatus and method for sharpening cutter blade shaft-mounted machine tool blades comprising: adjustably connecting a sharpening device to a blade sharpener; adjustably mounting the sharpener on a cutter blade shaft; and referencing a blade while sharpening the blade. The steps may be performed over and over with a same or different blades. In the preferred embodiment, adjustably mounting comprises providing a body member, preferably a plurality of independently adjustable arm members, most preferably a straight arm member, an angled arm member, and a pivotable arm member. Referencing a blade while sharpening the blade comprises engaging the back of the blade to be sharpened by the angled arm member. The sharpener is preferably a powered die grinder and adjustably connecting is done by a threaded connector having a lock to secure the position of the threaded connector relative to the body member.

The invention is also of a jig for sharpening machine tool blades comprising: a connector for adjustably connecting the jig to a powered sharpening device; a body member adjustable relative to the connector; and arms dependent from and adjustable relative to the body member. In the preferred embodiment, the connector is internally and externally threaded, the body member is internally threaded for engagement with the connector, the body member comprises a lock bolt for securing the position of the connector relative to the body member, and the jig comprises a plurality of adjustable arms, at least some of which engage a machine tool cutter shaft. At least one of the adjustable arms preferably engages a blade while the blade is sharpened.

The invention is also of an apparatus and method for sharpening rotary saw blades comprising: adjustably connecting a sharpening device to a rotary saw blade sharpener; adjustably mounting the sharpener adjacent a rotary saw blade; and referencing a saw tooth to be sharpened while sharpening the saw tooth. In the preferred embodiment, the invention further comprises mounting a pair of base members on either side of the rotary saw blade, referencing the saw tooth comprises mounting a pin upon the base member and wedging the pin under the saw tooth, the invention further comprises sharpening a saw tooth, removing the pin and rotating the rotary saw blade to an adjacent saw tooth to be sharpened, and sharpening the adjacent saw tooth, and sharpening the saw tooth comprises sharpening a saw tooth of one configuration, turning the base members end-for-end, and sharpening a saw tooth of another configuration.

The invention is further of an apparatus and method of sharpening router and shaper bits comprising: providing a table; protruding a powered sharpener a predetermined amount through the table; suspending a table surface from a pin support; and manually grinding a bit the predetermined amount while supporting the bit on the table and the table surface. In the preferred embodiment, the table has a hole therein through which the powered sharpening device protrudes. Suspending a table surface preferably comprises suspending a table surface complementary to and even with the powered sharpening device.

The invention is also of an apparatus for sharpening router and shaper bits comprising: a powered sharpening device; a table adjustably mounted adjacent the powered sharpening device; a pin support adjustably mounted above the table; and a pin and pin head adjustably suspended from the pin support; wherein the powered sharpening device protrudes above the means comprising a table an amount equal to the amount of material to be removed from a bit to be sharpened. In the preferred embodiment, the powered sharpening device is a powered die grinder, the table and pin support are adjustably supported by an arm mounted on the sharpening device, and the pin head provides a table surface complementary to and even with the powered sharpening device.

A primary object of the present invention is the setting and sharpening of machine cutter blades in situ;

Another object of the invention is the provision of a sharpening apparatus which can sharpen square or round cutter blades of any size;

A further object of the invention is the provision of a sharpening apparatus which can access cutter heads that are only 120° exposed;

Still another object of the invention is the provision of a sharpening apparatus which indexes the blade being ground;

A primary advantage of the present invention is its ease of manufacture and relatively low cost;

Another advantage of the present invention is that it not only sharpens jointers and planers, but mill heads with knife inserts as well;

Yet another advantage of the present invention is that it can sharpen carbide blades;

Still another advantage of the present invention is that the sharpening apparatus can be adjusted to very fine tolerances;

A further advantage of the present invention is its capability of grinding secondary bevels, resulting in less overall grinding; and Yet another advantage of the present invention is its capacity of sharpening saw blades, router and shaper bits.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
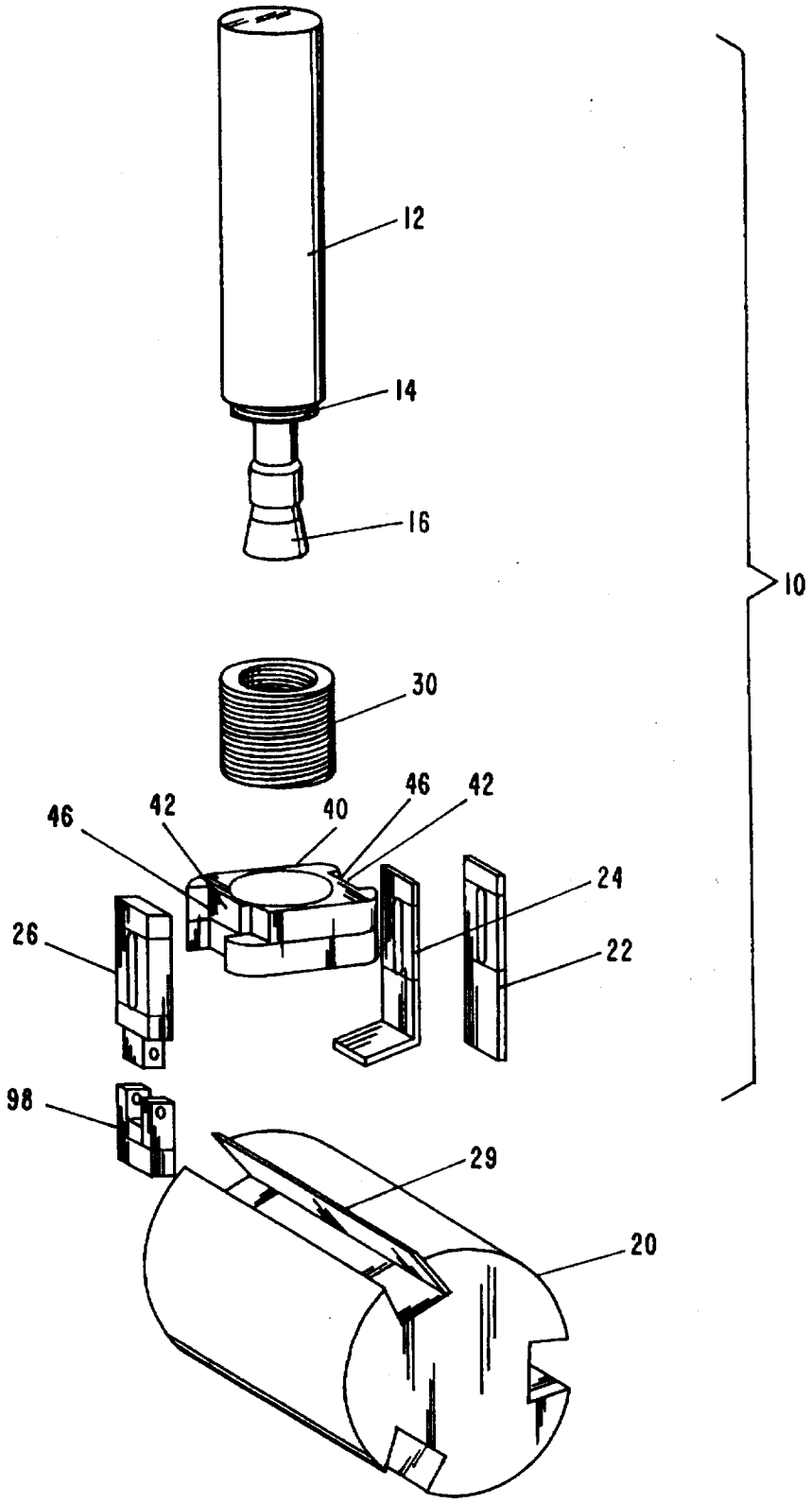
FIG. 1 is an articulated view of the preferred embodiment of the invention.
Figure 2:
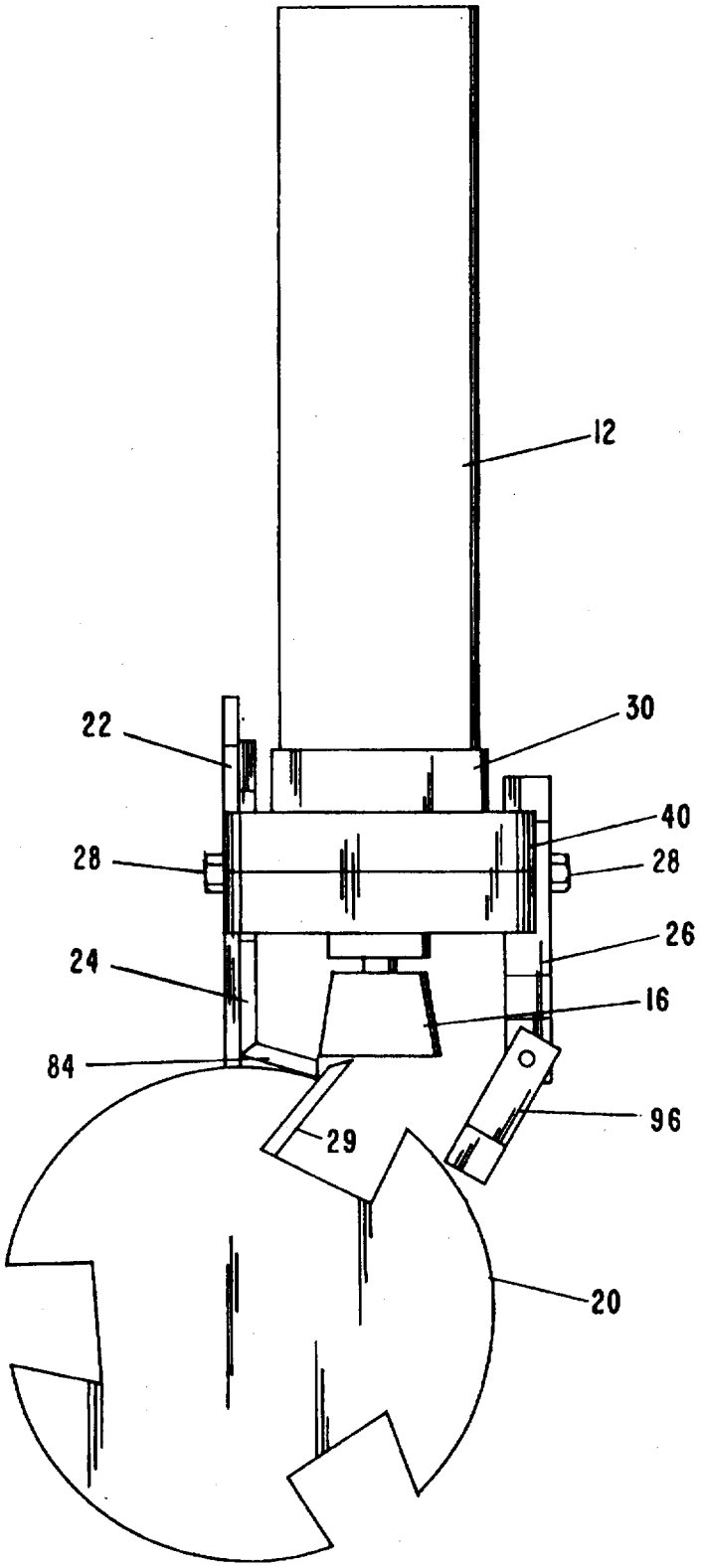
FIG. 2 is a perspective view of the preferred embodiment of the invention mounted upon a cutter head.

Reference is now made to FIGS. 1 and 2 which show the preferred embodiment of the sharpening apparatus of the invention. Sharpening apparatus 10 employs a grinding device 12, for example, a Blue Point AT 100B die grinder or the like, comprising exposed thread portion 14 on the lower housing thereof. Grinding stone 16 is attached to the shaft of grinding device 12.

Figure 3:
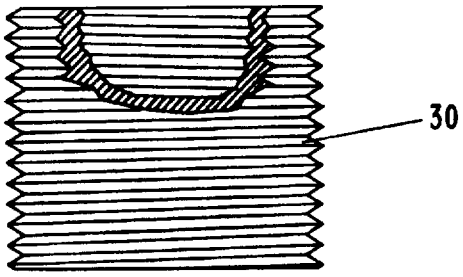
FIG. 3 is a cross-section of the connector of the preferred embodiment of the invention.

Threaded portion 14 of grinding device 12 attaches to cylindrical connector 30, which is internally threaded for a portion of its length to mate with the threaded portion 14 of the grinding device 12. Such threaded attachment also provides a rough length adjustment for the grinding stone 16. Further, connector 30 is also externally threaded through its length for attachment to body 40, as best shown in FIG. 3.

Body 40 comprises internal threads matching the external threads of connector 30 for connection thereto. Additionally, body 40 is generally rectangular in configuration. Sides 42 are slotted at 46 to receive arms 22, 24 and 26. Sides 42 are also drilled and threaded for set screws 28 for positioning and retaining arms 22, 24, and 26 in slots 46.

Figure 4:
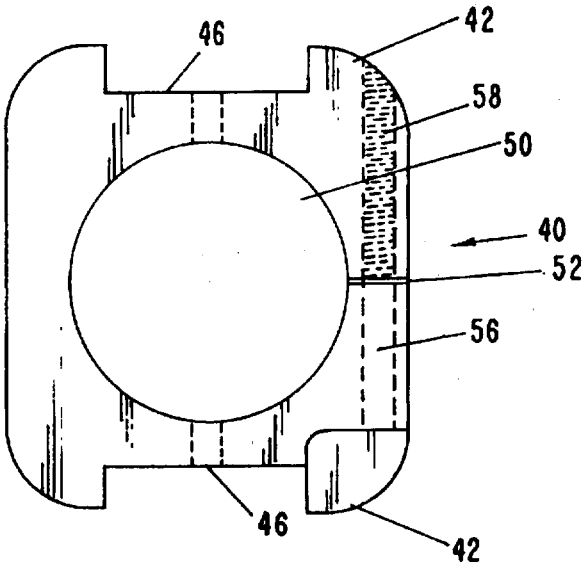
FIG. 4 is a top view of the body of the preferred embodiment of the invention.
Figure 5:
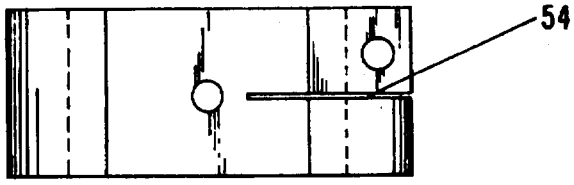
FIG. 5 is a cross-sectional view of FIG. 4 along A—A'.
Figure 6:
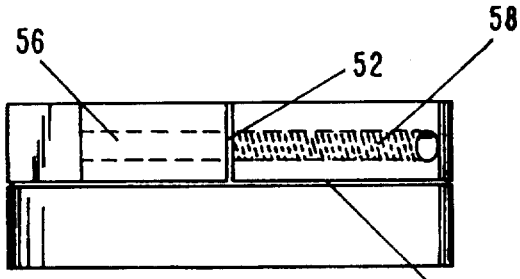
FIG. 6 is a side view of FIG. 4.

As best shown in FIGS. 4–6, body 40 further comprises saw-cut kerfs 52 and 54 perpendicular to each other. A lock bolt hole 56, threaded at 58, extends through body 40, also perpendicular to kerf 52. After connector 30 is properly screwed in to the proper depth in body 40, a lock bolt extending through lock bolt hole 56 and tightened in threaded portion 58 functions to securely hold body 40 and connector 30 in a selected position.

Figure 7:
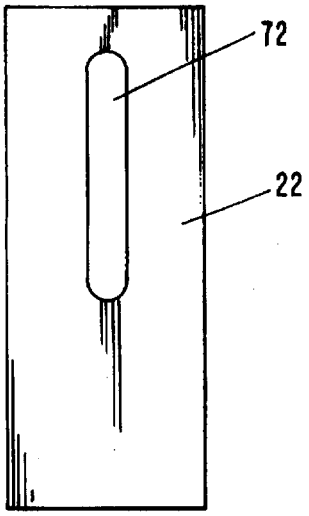
FIG. 7 is a frontal view of the straight arm of the preferred embodiment of the invention.

As shown in FIGS. 2 and 7, arm 22 comprises a straight slotted bar, preferably metallic. Straight arm 22 engages cutter head 20 with a predetermined pressure, and is adjustable lengthwise by means of slot 72 and set screw 28. Straight arm 22 and angled arm 24 are both accommodated in body slot 46.

Figure 8:
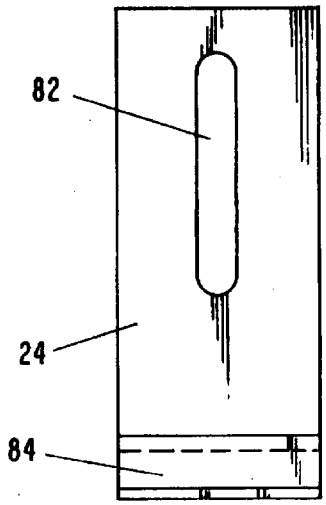
FIG. 8 is a frontal view of the angled arm of the preferred embodiment of the invention.
Figure 9:
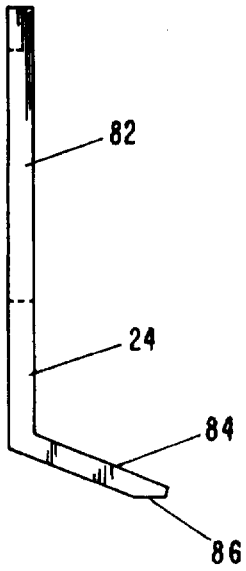
FIG. 9 is a side view of the angled arm of the invention.

As shown in FIGS. 2, 8 and 9, angled arm 24 also comprises a slotted portion 82 and is likewise adjustable lengthwise by relative positioning of slot 82 and set screw 28. Although both angled arm 24 and straight arm 22 reside within body slot 46, they are independently adjustable. Angled arm 24 bears directly upon the back of blade 29 thereby referencing blade 29 during the sharpening process, as well as providing a reference for the other cutter shaft blades to be sharpened.

Figure 10A:
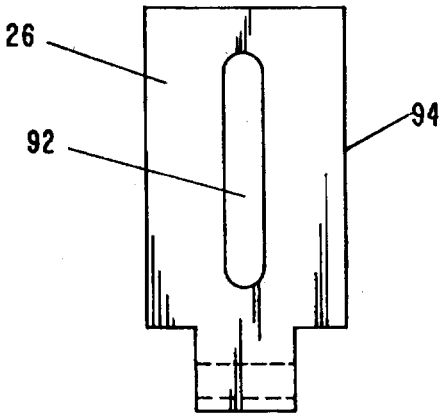
FIGS. 10(*a*) and 10(*b*) are frontal articulated views of the pivotable arm of the preferred embodiment of the invention.
Figure 11A:
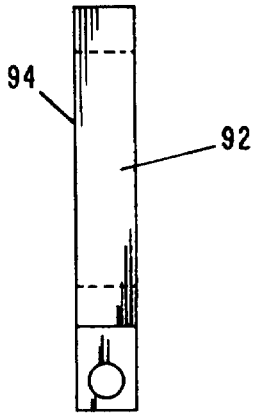
FIGS. 11(*a*) and 11(*b*) are side articulated views of the pivotable arm of the preferred embodiment of the invention.
Figure 10B:
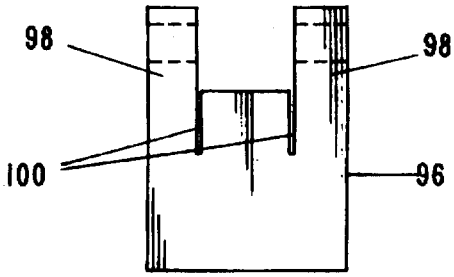
Figure 11B:
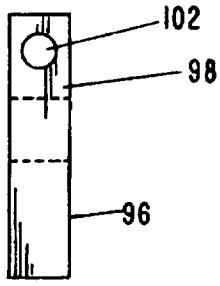
Figure 12:
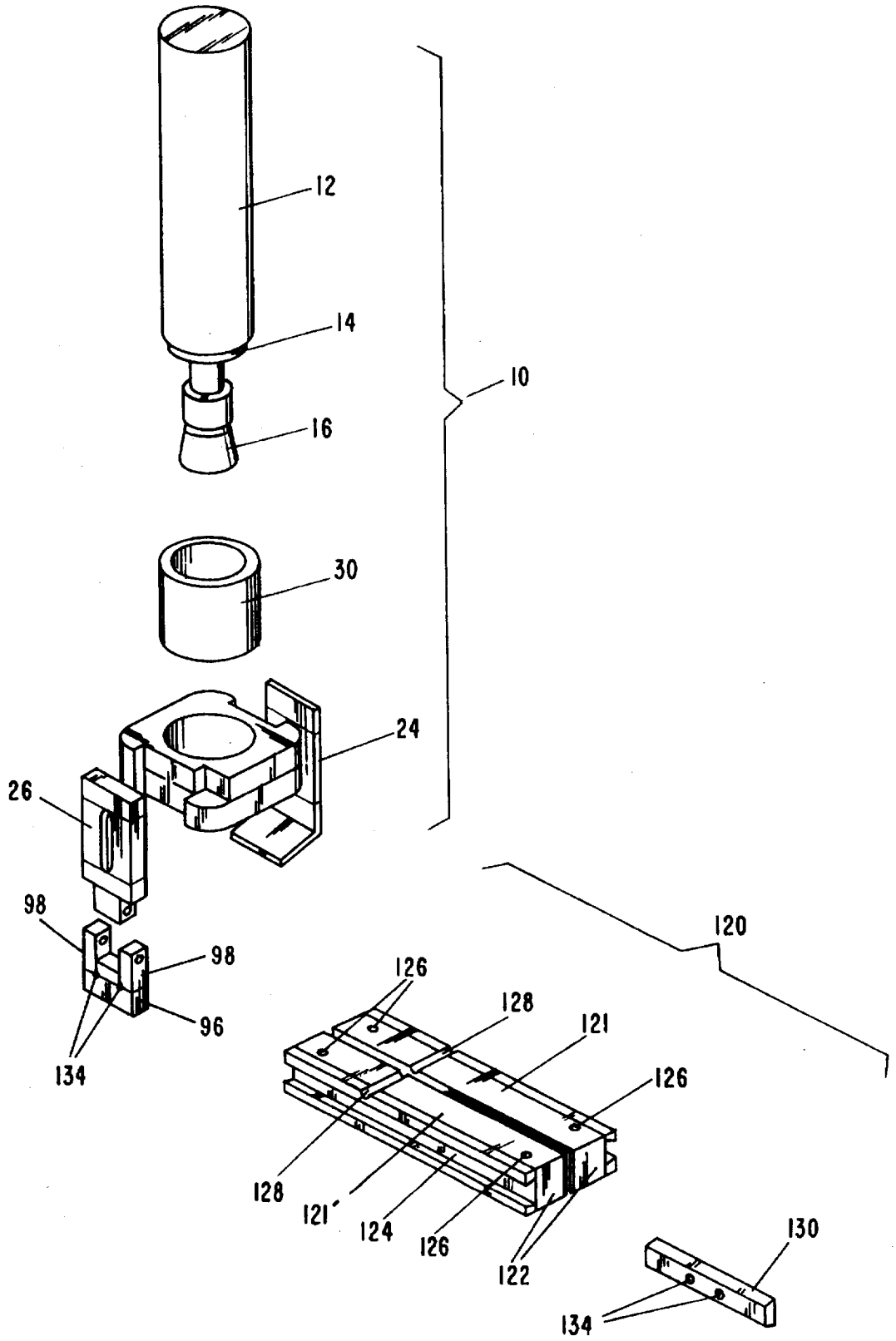
FIG. 12 is an articulated view of the second embodiment of the invention.

As shown in FIGS. 2, 10 and 11, pivotable arm 26 also comprises longitudinal adjustment slot 92. Pivotable arm 26 also comprises a depending arm portion 96 which is angularly adjustable to properly bear upon cutter shaft 20.

In using apparatus 10, all power to the planer/jointer must, of course, be disconnected or shut off. Cutter shaft 20 must be as exposed as possible (lower tables, remove fences, etc.), and rotated until one blade 29 is on top. Cutter shaft 20 is then wedged against rotation by any suitable means.

Sharpening device 12 is secured by screwing into connector 30, Connector 30 is rotated until the bottom portion clears body 40, as shown in FIG. 2. The arm set screws 28 are loosened, and arms 22 and 24 are adjustably brought to bear with some pressure upon cutter shaft 20 and blade 29, and secured respectively. Pivotable arm 26 is also both longitudinally and angularly adjusted until it bears upon cutter shaft 20, then fine adjusted to grind a secondary bevel upon blade 29.

The grinding stone 16 is adjusted by turning connector 30 until stone 16 almost touches blade 29. The lock bolt is tightened and the blade is manually traversed along the blade length. Readjustment of blade height, if necessary, is manually effected. The wedging device is removed and each blade is thus manually traversed and each blade's height is adjusted as necessary.

The wedging devices are replaced, and the sharpening device is connected to a power source. The lock bolt is loosened, and the connector 30 and sharpening device 12 are lowered until grinding stone 16 contacts blade 29. The lock bolt is re-tightened and blade 29 is ground while traversed thus providing a secondary bevel upon the blade. Each blade is thus sharpened in turn. Succeeding sharpening passes may be required; for each pass the sharpening device 12 is appropriately lowered. Optimum sharpening occurs by lowering the sharpening device no more than 0.0005" per pass. Upon completion, any remaining burrs are manually removed.

Figure 13:
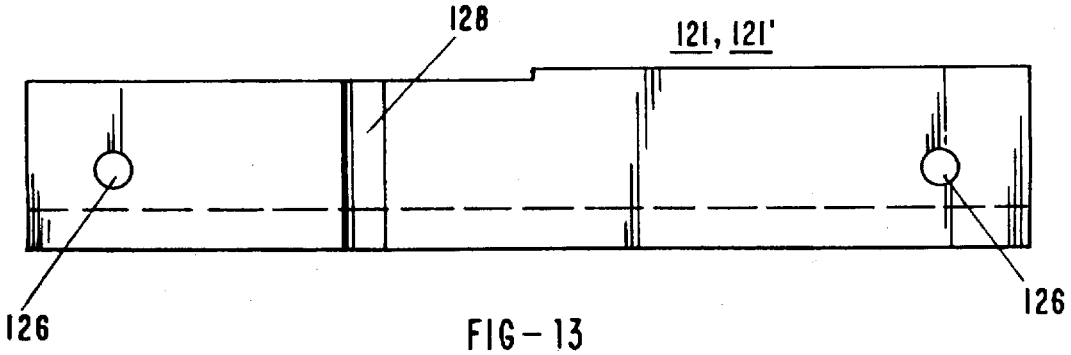
FIG. 13 is a top view of a base member of FIG. 12.
Figure 14:
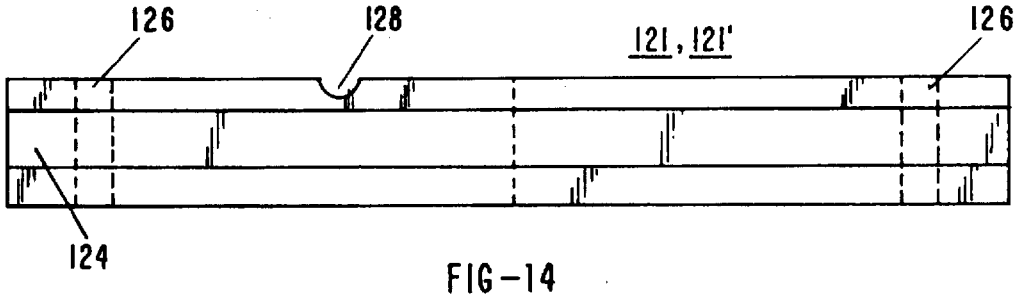
FIG. 14 is a side view of the base member of FIG. 13.
Figure 15:
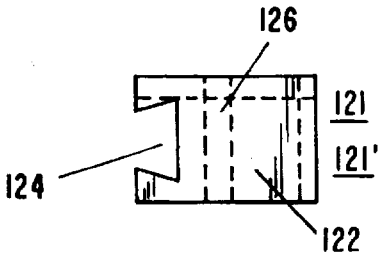
FIG. 15 is an end view of the base member of FIG. 14.

FIGS. 12–19 illustrate the second embodiment of the invention comprising adaptor structure for in situ sharpening of table saw blades. As shown in articulated perspective in FIG. 12, in addition to the previously disclosed apparatus 10, adaptor structure 120 comprises base members 121, 121'. Base members 121, 121' are reverse, or mirror images of each other. Each base member 121, 121' as best shown in FIGS. 13, 14 and 15, comprises support portion 122, dovetail mortise portion 124, screw holes 126, and pin slots 128.

Figure 16:
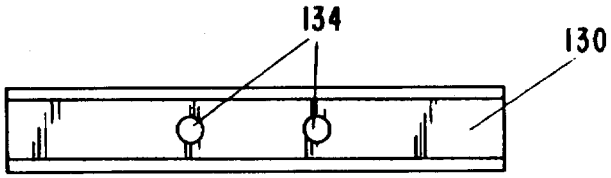
FIG. 16 is a side view of the tenon of FIG. 12.
Figure 17:
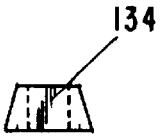
FIG. 17 is an end view of the tenon of FIG. 16.
Figure 18:
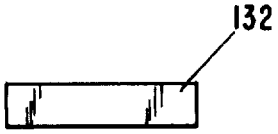
FIG. 18 is a top view of the pin of FIG. 12.

The table saw blade adaptor structure further comprises dovetail tenon portion 130, as shown in FIGS. 5, 16 and 17, and pin 132, shown in FIG. 18, as well as appropriate wood screws (not shown) and bolts (also not shown).

Figures 19, 20:
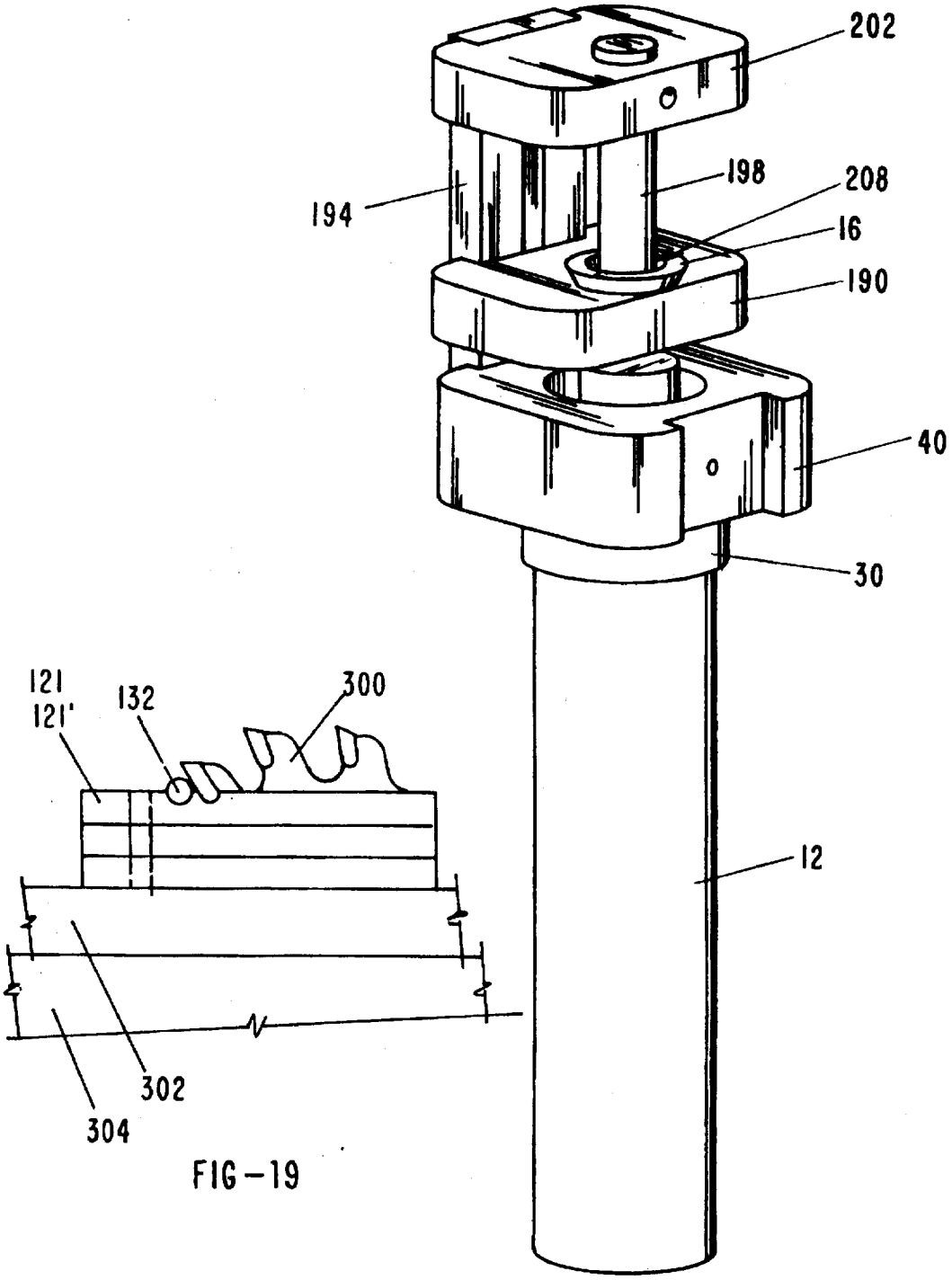
FIG. 19 is a side view of the second embodiment of the invention positioned upon a table saw.
FIG. 20 is a perspective view of the third embodiment of the invention.

In use, as shown in FIG. 19, the circular table saw blade member 300 is used to cut approximately halfway through a piece of wood stock 302, e.g., approximately 4" wide. The saw is then stopped; the blade and wood stock are then disengaged from each other so as to be freely movable relative to each other, including up-down, back-and-forth motion, and blade rotary motion.

Base members 121, 121' are positioned on each side of the rotary saw blade. Base members 121, 121' are also positioned to freely allow rotary and up-and-down motion of the rotary saw blade 300. Pin 132 placed in pin slots 128 correctly positions base members 121, 121' relative to each other.

As shown in FIG. 19, the wood stock 302 and base members 121, 121' mounted thereon are moved back and forth while rotating the rotary saw blade until a selected blade tip is brought parallel to bases 121, 121' and the face of the blade is pressed and wedged against pin 132. At this point wood screws in holes 126 are used to secure bases 121, 121' to the wood stock 302. The wood stock 302 is secured to the table 304 of the saw 300 using C-clamps (not shown).

Dovetail tenon 130 is then secured to depending pivotable arm portion 96 by screw holes 134. Tenon 130 is then inserted into mortise 124, and the sharpening apparatus is properly positioned and secured over the selected blade tip. Sharpening proceeds as previously disclosed with planer/jointer blade sharpening.

Each blade tip of similar configuration can be successively sharpened by removing pin 132, rotating the next blade tip into position, and re-inserting and wedging pin 132 against the blade tip. However, with rotary saw blades that are alternatively beveled, each blade tip of similar configuration is successively sharpened; after completion of sharpening of such similarly configured blades, tenon 130 is turned end-for-end on bases 121, and the blades of opposite configuration are then sharpened.

The third embodiment of the invention, router and shaper bit sharpener apparatus, is depicted in FIGS. 20–24. Again, powered grinder 12 serves as a power source, albeit in inverted configuration. Grinder 12 is screw-connected to connector 30, in turn screw-connected to body 40, all as previously disclosed.

Figure 21:
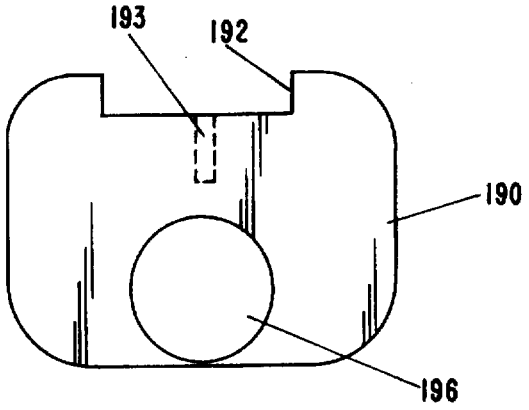
FIG. 21 is a top view of the table of FIG. 20.

The router and bit shaper apparatus further comprises table 190. Table 190, as best shown in FIG. 21, also comprises a slot portion 192 for accommodating supporting arm 194. Arm 194 is supported by body 40 and, in turn, supports table 190 at any desired elevation above body 40. Table 190 further comprises hole 196 for receiving grinding stone 16 therethrough. Normally, table 190 is adjusted to a height such that 0.001" of grinder stone 16 protrudes above table 190.

Figure 22:
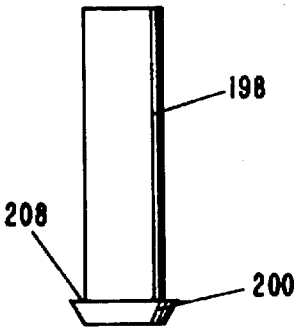
FIG. 22 is a side view of the pin and pin head of FIG. 20.
Figure 23:
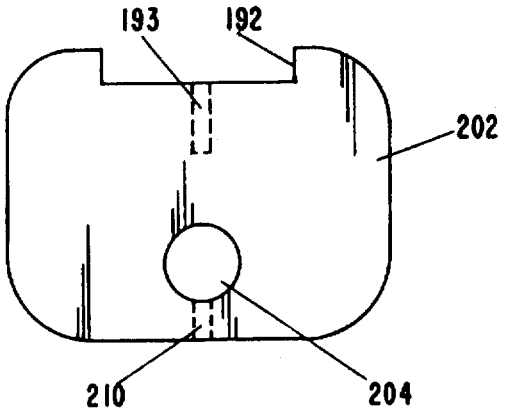
FIG. 23 is a top view of the pin support of FIG. 20.

The router and shaper apparatus further comprises pin 198 having head portion 200, as shown in FIG. 22, supported in hole 204 in pin support 202, shown in FIG. 23, and functions to align and reference grinding stone 16 by providing a table surface 208 complementary and level with the upper surface of grinding stone 16.

Figure 24:
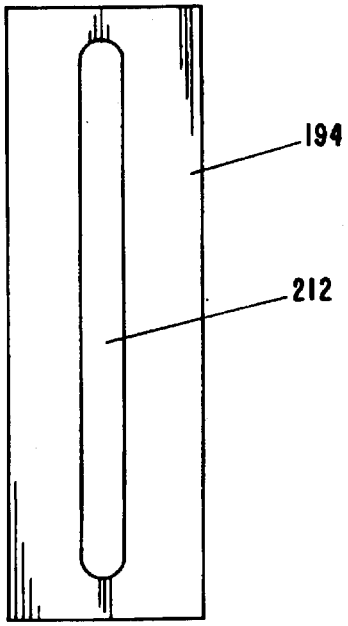
FIG. 24 is a side view of the arm of FIG. 20.

Both table 190 and pin support 202 have threaded bolt holes 193 in their respective slotted portions 192 for adjustable connection to slot 212 in arm 194. Arm 194, as shown in FIG. 24, is similar to previously disclosed arm 22 but is of thicker configuration. Pin support 202 further comprises threaded bolt hole 210 for securing pin 198 in hole 204 by a lock screw (not shown).

In use, connector 30 and body 40 are assembled to grinder 12 and grinding stone 16 as previously disclosed, but in inverted configuration.

Arm 194 is secured to body 40, and table 190 is connected to arm 194 at any desired elevation below the topmost edge of grinding stone 16. This protrusion of grinding stone 16 above table 190 represents the desired amount of material to be removed, normally 0.001". Pin support 202, with pin 198 in hole 204, is also loosely secured to arm 194.

Thereafter, pin 198 is lowered until pin head 200 is even with the top of grinding stone 16. Then, pin 198 is secured with a lock screw and pin support 202 is secured tightly to arm 194. Further fine adjustment of grinding stone 16 is effected by rotation of connector 30.

Actual sharpening of routing and shaper bits is effected manually. The bits are "fed" into grinding stone 16 using table 190 as a support until the desired amount of material is removed.

Industrial Applicability

The invention is further illustrated by the following nonlimiting examples.

EXAMPLE A

The powered grinding device 12 may be a Blue Point AT 100B die grinder or any similar grinding device. The grinding device should, however, operate at 20,000 to 25,000 rpm and should have at least a portion of the housing externally threaded (preferably ¼" at 16 TPI with an external diameter of 1-⅜").

As best shown in FIG. 3, connector 30 is of a metallic (preferably steel) or suitable plastic composition with a length of 1-½, an O.D. of 1-¾" and an I.D. of 1-⅜" and preferably anodized red. Connector 30 is internally threaded for at least ¾" with female threads at 16 TPI (or suitably match the exterior threads of the powered die grinder). The external diameter of connector 30 is threaded throughout its length with 32 TPI.

As best shown in FIG. 4, body 40 is generally of rectangular configuration, of suitable metallic or plastic composition, and anodized red in color. Body 40 is 2-½" wide, 2-¾ "long, 1" thick and has opposed slots 46 1-¼" across and ¼" deep. The four corners of body 40 are rounded to ½". Cavity 50 is 1-¾" in diameter and threaded with 32 TPI for mating with connector 30.

Kerfs 52 and 54 are sawed into body 40 to provide a locking mechanism for connector 30. Kerf 52 is sawed downwardly for ½" and intersects kerf 54 at a right angle. Extending generally parallel to kerf 54 and also extending along the entire length of body 40 is lock bolt hole 56. Lock bolt hole 56 is unthreaded half of its length and threaded with #10 20 TPI for the remaining half of its length, at 58, thereby enabling screw engagement with a #10 20 TPI bolt. Such engagement, of course, securely retains connector 30 within body 40.

Slot 46 also has a #10 20 TPI threaded holes therein for reception and retention of set screws 28. Set screws 28 independently and adjustably retain arms 22, 24 and 26 within slots 46.

Straight arm 22 as best depicted in FIGS. 2 and 7 comprises an elongate bar suitably composed of metal, plastic or the like. Arm 22 is preferably 3" long, 1-¼" wide and ⅛" thick. Arm 22, as shown in FIG. 2, engages the cutter shaft thereby referencing the shaft and further insuring against shaft rotation. Straight arm 22 comprises ¼" wide, 1-¼" long elongate slot 72 which, in cooperation with set screw 28 enables independent longitudinal adjustment of arm 22.

Angled arm 24, best shown in FIGS. 2, 8 and 9 preferably originally comprises a stock bar 3-¾" long, 1-¼" wide and ⅛"1-3/16" from the bottom of the bar, thus creating an angled finger portion 84. The bottom of the angled finger portion 84 is milled at 90° relative to the downwardly depending portion of the arms, at 86, leaving 1/16" or less of the original end remaining. Angled arm 24 is also ⅛" thick, and comprises centered elongate slot 82 1-¼" long and ¼" wide. The finger portion 84 engages the back of the blade to be sharpened, thereby establishing a true index for both blade setting and blade sharpening for all blades.

Pivotable arm 26 engages the forward portion (relative to direction of rotation) of the cutter shaft, as best shown in FIG. 2. As shown in FIGS. 10 and 11 pivotable arm 26 also comprises suitable stock, the top portion 94 of which is ⅜" thick, 2-½" long and 1-¼" wide. Top portion 94 also contains a ¼" slot 92 1-¼" long. Two 5/16" wide ½" long bottom portions are milled away, leaving a bottom portion ⅝" wide and ½" long with an unthreaded bolt hole formed therein.

Depending pivotable arm portion 96 comprises two upstanding portions 98, 98 each 5/16" wide and spaced ⅝" apart. Each upstanding portion 98, 98 also comprises a threaded bolt hold (#10 20 TPI bolt) 102, as well as kerfs 100 adjacent upstanding portion 98, 98. Engagement of a #10 20 TPI bolt through bolt holes 102 and subsequent tightening, serves to lock depending arm portion 96 in any desired angular position for engagement with cutter shaft 20, as shown in FIG. 2.

EXAMPLE B

Bases 121, 121' of the rotary saw blade adaptor structure 120 each comprise aluminum bar stock 6" long, reduced at mid-length from 1-1/16" width to 1" in width, as shown in FIG. 13. One side of each base 121 has dovetail mortise 124 therein. Dovetail mortise 124 comprises a ¼" deep slot, as shown in FIG. 15, having sloping top and bottom sides, the opening increasing from ⅜" outwardly to ½" internally.

Pin slot 128 comprises a ¼" diameter semi-cylinder, the center of which is 2" from an end of bases 121. Screw holes 126 one 3/16" diameter and suitably accept wood screws for securing bases 121 to wood stock.

Dovetail tenon 130, shown is FIGS. 16 and 17, preferably also of aluminum stock and comprises a 3" bar having sloping sides to mate with mortise 124. Holes 134 each comprise #10 20 TPI threaded holes for accepting suitable bolts for securing tenon 130 to similar holes 134 in depending pivot arm portion 96.

Pin 132 shown in FIG. 18, ¼" in diameter and 1-⅛" in length preferably comprises steel or other metal of requisite hardness and toughness.

EXAMPLE C

Table 190 is of similar configuration to body 40, and preferably also comprises steel composition. Table 190 also comprises 0.375" deep slot 192 with a ¼" diameter threaded locking screw hole 193 centered therein. Hole 196 for reception of grinding stone 16 is 1" in diameter, centered 1.375" from the top edge of slot 192, and 1.25" from the side edges, and also centered on the locking screw hole. Table 190 is 0.5" thick.

Similarly, pin support 202 is of steel composition and 0.5" in thickness. Hole 204 for reception of pin 198 is 0.5" in diameter and centered similarly to hole 196. In addition to locking screw hole 193, pin support 202 also comprises locking screw hole 210 for securing pin 198 to pin support 202.

Pin 198 and pin head 200 comprise a 2" steel pin. Pin 198 is 0.5" in diameter, while pin head 200 slopes from 0.6875" diameter to 0.5" diameter over a length of 0.125".

Arm 194 preferably comprises steel bar stock 0.375" thick. Arm 194 is 4" in length and 1.25" wide. Slot 212 is 0.25" in width and 3-¼" long.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. An apparatus for supporting a sharpening device for sharpening machine tool blades mounted on a shaft comprising:

means for adjustably connecting the sharpening device to said apparatus;

means for adjustably and solely mounting said apparatus and said sharpening device on the blade shaft; and means for referencing the blade to be sharpened solely to said shaft while sharpening said blade.

2. The apparatus of claim 1 wherein said sharpening device comprises a powered die grinder.

3. The apparatus of claim 1 wherein said means for connecting said sharpening device to said apparatus comprises a threaded connector.

4. The apparatus of claim 1 wherein said means for adjustably and solely mounting said apparatus and said sharpening device comprises a body member.

5. The apparatus of claim 4 wherein said body member further comprises a plurality of arm members.

6. The apparatus of claim 5 wherein at least some of said plurality of arm members engage said cutter blade shaft.

7. The apparatus of claim 5 wherein each of said plurality of arm members is independently adjustable.

8. The apparatus of claim 5 wherein at least one of said plurality of arm members comprises a straight arm member, at least another of said plurality of arm members comprises an angled arm member, and yet another arm member of said plurality of arm members comprises a pivotable arm member.

9. The apparatus of claim 8 wherein said angled arm member engages the back of said blade to be sharpened thereby providing an index for said blades.

10. The apparatus of claim 4 wherein said body member further comprises locking means for securing the position of said threaded connector relative to said body member.

11. A method for sharpening machine tool blades mounted on a shaft comprising the steps of:

a) adjustably connecting a sharpening device to an apparatus for sharpening blades;

b) adjustably and solely mounting the apparatus and the sharpening device upon a cutter blade shaft; and c) referencing a blade solely to the cutter blade shaft while sharpening the blade.

12. The method of claim 11 wherein the step of adjustably mounting the apparatus and the sharpening device further comprises the step of providing a body member.

13. The method of claim 12 wherein the step of providing a body member further comprises the step of providing a plurality of arm members.

14. The method of claim 13 further comprising the step of independently adjusting the plurality of arm members.

15. The method of claim 14 wherein the step of providing a plurality of arm members further comprises the step of providing a straight arm member, an angled arm member and a pivotable arm member.

16. The method of claim 11 wherein the step of referencing a blade while sharpening the blade further comprises the step of engaging the back of the blade to be sharpened by the angled arm member.

17. The method of claim 11 further comprising the steps of repeating steps a) through c) and thereby sharpening another blade.

* * * * *